US008862036B2

(12) United States Patent
Maeshima

(10) Patent No.: US 8,862,036 B2
(45) Date of Patent: Oct. 14, 2014

(54) IMAGE FORMING APPARATUS AND DEVELOPER CONTAINER REMOVABLY CONNECTED THERETO

(71) Applicant: Kyocera Document Solutions Inc., Osaka (JP)

(72) Inventor: Masanobu Maeshima, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 87 days.

(21) Appl. No.: 13/775,382

(22) Filed: Feb. 25, 2013

(65) Prior Publication Data

US 2013/0259534 A1 Oct. 3, 2013

(30) Foreign Application Priority Data

Mar. 29, 2012 (JP) ..... 2012-076321

(51) Int. Cl.
*G03G 21/16* (2006.01)
*G03G 15/08* (2006.01)

(52) U.S. Cl.
CPC ..... *G03G 15/0886* (2013.01); *G03G 15/0872* (2013.01); *Y10S 222/01* (2013.01)
USPC ..... 399/262; 399/260; 222/DIG. 1

(58) Field of Classification Search
CPC ..... G03G 15/0872; G03G 2215/067; G03G 2215/0692
USPC ..... 222/DIG. 1; 399/260, 262
See application file for complete search history.

(56) References Cited

U.S. PATENT DOCUMENTS

| | | | | |
|---|---|---|---|---|
| 4,915,364 | A * | 4/1990 | Perlini | 267/64.26 |
| 5,441,177 | A * | 8/1995 | Yanagisawa | 222/167 |
| 5,722,014 | A * | 2/1998 | Fike | 399/119 |
| 8,005,406 | B2 * | 8/2011 | Hosokawa et al. | 399/258 |

FOREIGN PATENT DOCUMENTS

| | | |
|---|---|---|
| JP | 08-339115 | 12/1996 |
| JP | 2008-225072 | 9/2008 |

* cited by examiner

*Primary Examiner* — Clayton E Laballe
*Assistant Examiner* — Leon W Rhodes, Jr.
(74) *Attorney, Agent, or Firm* — Morgan, Lewis & Bockius LLP

(57) ABSTRACT

An image forming apparatus has a developer container removably connected thereto, a developer feeding mechanism, a drive mechanism, and a torque limiter. The developer container includes a cylindrical container body having a developer discharge port, and a shutter fitted to be rotatable to open and close the developer discharge port. When the drive mechanism rotates the developer container in the developer feeding direction, while the torque limiter keeps the shutter stationary, the container body rotates through a predetermined angle to open the developer discharge port, and as the developer container continues to be rotated, the developer is fed through the developer discharge port. When the developer container is rotated in the direction reverse to the developer feeding direction, while the torque limiter keeps the shutter stationary, the container body rotates through a predetermined angle in the reverse direction to close the developer discharge port.

7 Claims, 9 Drawing Sheets

IMAGE FORMING APPARATUS AND DEVELOPER CONTAINER REMOVABLY CONNECTED THERETO

INCORPORATION BY REFERENCE

This application is based on and claims the benefit of Japanese Patent Application No. 2012-76321 filed on Mar. 29, 2012, the contents of which are hereby incorporated by reference.

BACKGROUND

The present disclosure relates to image forming apparatuses such as copiers, facsimile machines, and printers, and to removable developer containers incorporated in such image forming apparatuses. More particularly, the present disclosure relates to an opening/closing mechanism for a developer discharge port in developer containers that feed developer by rotation of the container body.

Conventionally, for easy maintenance, development devices incorporated in image forming apparatuses are filled with predetermined amounts of developer (toner) and, when the developer runs out, the whole development devices are replaced. For an economical point of view, however, frequent replacement of developing devices is impractical, and accordingly, to permit image formation on a satisfactorily large number of sheets, there is no choice but increase the capacity of developer. This makes the just-mentioned method unsuitable for size reduction. For the size reduction of developing devices, therefore, there have been proposed developer containers, such as toner containers and toner cartridges, that are provided separately from developing devices, and developing devices of the type that feeds developer by use of a developer feeding mechanism such as an intermediary hopper.

Known methods of feeding developer to a developing device includes one according to which developer is fed from a developer container where it is contained directly to the developing device, and one according to which a developer container is coupled to a developer feeding mechanism and developer inside the developer container is stirred and transported by the developer feeding mechanism to as to be fed from a predetermined position to the developing device. Also known is a technology according to which no stirring/transporting member is used but a developer container itself is rotated to transport developer to a desired position.

A method relying on rotation of a developer container itself eliminates the need to provide a stirring/transporting member inside the developer container, and thus has the advantages of increasing the amount of developer that can be contained in the developer container and reducing the cost of the developer container. In addition, the developer is then not subjected to the rotating load of the stirring/transporting member during transport, and is thus saved from deteriorating under mechanical stress.

Inconveniently, however, a method relying on rotation of a developer container itself as described above has the disadvantage that, when the developer container is connected or removed, the developer may leak through a developer discharge port formed in the developer container. This may lead to contamination of the maintenance person and the inside of the image forming apparatus with the leaked toner, and thus adversely affects the ease of handling and maintenance.

As a solution, there have been proposed developer containers that are easy to handle, without the risk of developer leakage, and easy to replace. For example, in one known toner container, a toner container holding member that has an inner wall which makes contact with a toner discharge port in a toner containing portion in a predetermined position to close the toner discharge port is provided so as to be movable, by a feed screw mechanism, relative to the toner container body in the rotation axis direction of the toner container body.

In this toner container, when the toner container body is rotated relative to the toner container holding member in the direction reverse to the rotation direction for toner discharge out of the toner containing portion, the toner containing portion and the inner wall of the toner container holding member come into contact with each other, and thus the toner discharge port is closed. When the toner container body is rotated relative to the toner container holding member in the rotation direction for toner discharge out of the toner containing portion, the toner containing portion and the inner wall of the toner container holding member come apart from each other, and thus the toner discharge port is opened.

With the construction described above, removing the toner container with completely no toner inside the toner container body proceeds with no problem. On the other hand, removing the toner container with toner remaining inside the toner container body may result in, while the toner container body is rotated in the reverse direction to close the toner discharge port, toner being caught between the toner containing portion and the toner container holding member. This hampers smooth operation of the feed screw mechanism which waves the toner container holding member relative to the toner container body, and thus, if the toner container is removed with the toner discharge port closed incompletely, toner may leak.

SUMMARY

According to one aspect of the present disclosure, an image forming apparatus is provided with a developer container, a developer feeding mechanism, a drive mechanism, and a torque limiter. The developer container is removably connected to an image forming apparatus main body, and includes a cylindrical container body in which developer is contained, a developer discharge port which is formed at one end of the container body and through which the developer inside the container body is discharged, and a shutter which is rotatable through a predetermined angle relative to the container body, is so fitted as to restrict rotation relative to the container body at both ends of the predetermined angle, and has an opening formed in part of the surface thereof facing the developer discharge port. The container body is rotated in the circumferential direction to cause the developer to be discharged through the developer discharge port. The developer feeding mechanism rotatably supports the developer container, and feeds the developer discharged through the developer discharge port to a developing device. The drive mechanism drives the developer container to rotate in the developer feeding direction. The torque limiter is provided on the developer feeding mechanism, and engages with the shutter when the developer container is connected to the image forming apparatus main body. The image forming apparatus is configured such that, when the developer container is rotated in the developer feeding direction, while the torque limiter keeps the shutter stationary, the container body rotates through a predetermined angle to open the developer discharge port, and as the developer container continues to be rotated, the shutter, while keeping the developer discharge port open, rotates together with the container body to allow the developer to be fed through the developer discharge port, and when the developer container is rotated in the direction reverse to the developer feeding direction, while the torque limiter keeps the shutter stationary, the container body rotates through a predetermined angle in the reverse direction to close the developer discharge port According to another aspect of the present disclosure, a developer container is removably connected to an usage forming apparatus which is provided with a developer feeding mechanism which rotatably supports a developer container and which feeds developer discharged through a developer discharge port formed in the developer container to a developing device, a drive mechanism which drives the developer container to rotate in the developer feeding direction, and a torque limiter which is provided on the developer feeding mechanism and which, when the developer container is connected to an image forming apparatus main body, engages with a shutter which is rotatably fitted to a container body of the developer container and which has an opening formed in part of the surface thereof facing the developer discharge port. The image forming apparatus is configured such that, when the developer container is rotated in the developer feeding direction, while the torque limiter keeps the shutter stationary, the container body rotates through a predetermined angle to open the developer discharge port, and as the developer container continues to be rotated, the shutter, while keeping the developer discharge port open, rotates together with the container body to allow the developer to be fed through the developer discharge port, and when the developer container is rotated in the direction reverse to the developer feeding direction, while the torque limiter keeps the shutter stationary, the container body rotates through a predetermined angle in the reverse direction to close the developer discharge port. The developer container is provided with a container body, a developer discharge port, and a shutter. The container body is cylindrical, and contains the developer therein. The developer discharge port is formed at one end of the container body, and allows the developer inside the container body to be discharged therethrough. The shutter is fitted so as to be rotatable through a predetermined angle relative to the container body, and has an opening formed in part of the surface thereof facing the developer discharge port. The container body is rotated in the circumferential direction to cause the developer to be discharged through the developer discharge port.

These and other objects of the present disclosure, and the specific benefits obtained according to the present disclosure, will become apparent from the description of embodiments which follows.

DETAILED DESCRIPTION

Figure 1:
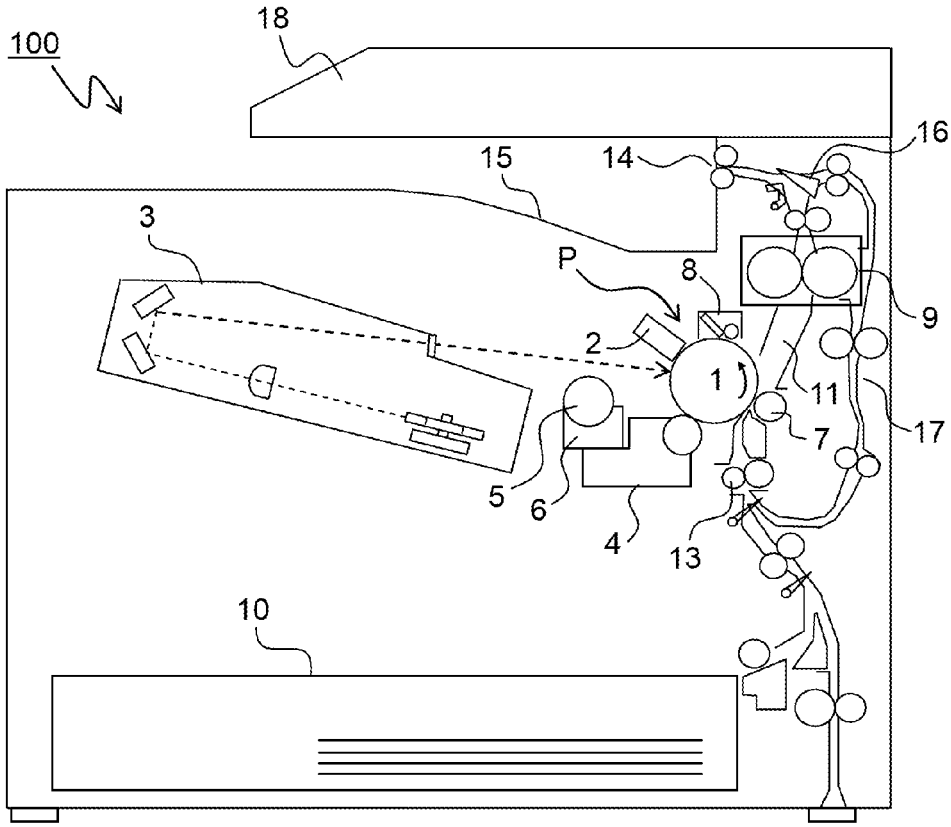
FIG. 1 is a schematic sectional view of the image forming apparatus 100 according to one embodiment of the present disclosure.

Hereinafter, an embodiment of the present disclosure will be described with reference to the accompanying drawings. FIG. 1 is a schematic sectional view of an image forming apparatus 100 as one embodiment of the present disclosure. Inside the main body of the image forming apparatus 100 (for example, a monochrome multifunction product), there is arranged an image forming section P which forms a monochrome image through the processes of charging, exposure, development, and transfer.

In the image forming section P, along the rotation direction of a photosensitive drum 1 (in the counter-clockwise direction in FIG. 1), there are arranged a charging section 2, an exposure unit 3, a developing device 4, a transfer roller 7, a cleaning device 8, and a charge neutralizing device (not shown). In the image forming section P, while the photosensitive drum 1 is rotated in the counter-clockwise direction in FIG. 1, the image forming processes are performed with respect to the photosensitive drum 1.

The photosensitive drum 1 has, for example, a photosensitive layer laid on an aluminum drum, and its surface is electrically charged by the charging section 2. When the surface is irradiated with a laser beam from the exposure unit 3, which will be described later, an electrostatic latent image is formed through attenuation of electric charge. Preferred as the photosensitive layer is, for example, but not limited to, amorphous silicon (a-Si), which excels in durability, or an organic photosensitive layer (OPC), which produces little ozone during charging and which offers a high-resolution image.

The charging section 2 is for electrically charging the surface of the photosensitive drum 1 evenly. Used as the charging section 2 is, for example, a corona discharge device which produces electric discharge by applying a high voltage to an electrode such as a piece of fine wire. Instead of a corona discharge device, a contact-type charging device may be used which achieves application of a voltage while a charging member, as exemplified by a charging roller, is in contact with the surface of the photosensitive drum. The exposure unit 3 irradiates the photosensitive drum 1 with a light beam (for example, a laser beam) according to document image data read by an image reading section 18, and thereby forms an electrostatic latent image on the surface of the photosensitive drum 1.

The developing device 4 is for letting toner adhere to the electrostatic latent image on the photosensitive drum 1 in form a toner image. The feeding of toner to the developing device 4 is effected from a toner container 5 via an intermediary hopper 6. Here, a single-component developer (hereinafter simply called toner) composed of a magnetic toner component alone is contained in the developing device 4. The developing device 4, the toner container 5, and the intermediary hopper 6 will be described in detail later.

The transfer roller 7 transfers, without disturbing, the toner image formed on the surface of the photosensitive drum 1 onto a sheet of paper which is transported along a paper transport passage 11. The cleaning device 8 is provided with a cleaning roller, cleaning blade, or the like which makes line contact with the photosensitive drum 1 in its longitudinal direction, and removes remnant toner which remains on the surface of the photosensitive drum 1 after the transfer of the toner image onto the sheet.

The image reading section 18 is composed of, among others, a scanning optical system including a scanner lamp which illuminates the document during copying and a mirror which changes the optical path of the light reflected from the document, a condenser lens which condenses and focuses the light reflected from the document, and a CCD sensor which converts the focused image light into an electrical signal (none is shown). The image reading section 18 reads the document image and converts it into image data.

Copying operation proceeds as follows. The image reading section 18 reads the image data of the document and converts it into an image signal. On the other hand, in the image forming section P, the charging section 2 electrically charges, evenly, the photosensitive drum 1 which rotates in the counter-clockwise direction in FIG. 1. Based on the document image data read by the image reading section 18, the exposure unit 3 irradiates the photosensitive drum 1 with a laser beam (light beam) so as to form an electrostatic latent image based on the image data on the surface of the photosensitive drum 1. Subsequently, the developing device 4 lets toner adhere to the electrostatic latent image to form a toner image.

Toward the image forming section P in which the toner image is formed as described above, a sheet of paper is transported with predetermined timing from a paper accommodating section 10 via the paper transport passage 11 and a pair of resist rollers 13 so that, in the image forming section P, the transfer roller 7 transfers the toner image on the surface of the photosensitive dram 1 onto the sheet. The sheet having the toner image transferred onto it is separated from the photosensitive drum 1, and is transferred to a fixing section 9, where the sheet is heated and pressed so that the toner image is fixed on the sheet.

The sheet having passed through the fixing section 9 has its transport direction selected by a transport guide member 16 arranged at a branching portion in the paper transport passage 11, so as to be ejected either intact (or after being transported to a reversing transport passage 17 and subjected to two-side copying) via a pair of ejection rollers 14 to a sheet ejection section 15.

Figure 2:
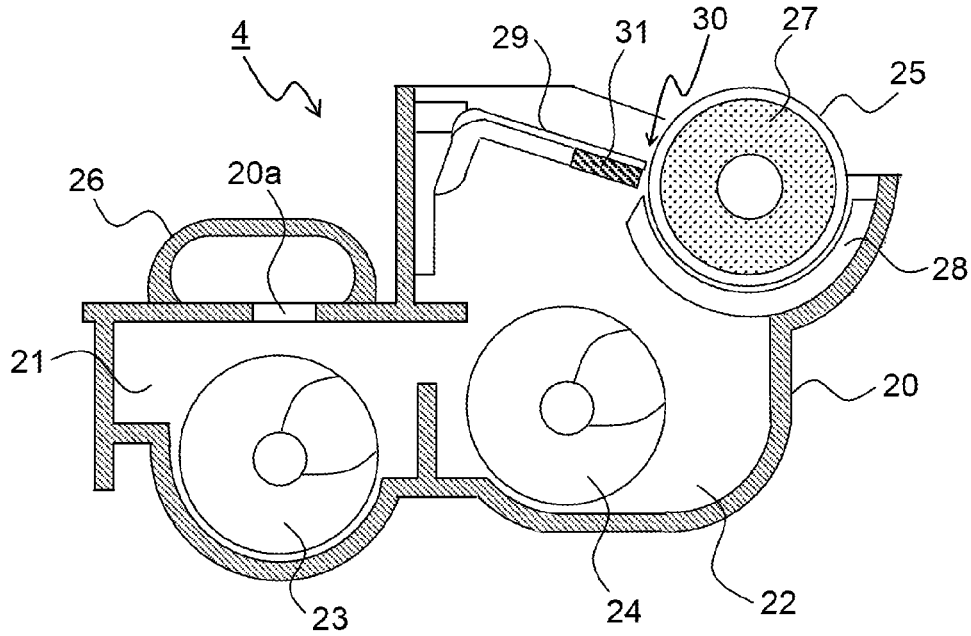
FIG. 2 is a side sectional view of the developing device 4 incorporated in the image forming apparatus 100 according to the present disclosure.

FIG. 2 is a side sectional view of the developing device 4. As shown in FIG. 2, inside a developing container 20, a first storage compartment 21 and a second storage compartment 22 are formed by a partition wall (not shown) which is formed integrally with the developing container 20. In the first storage compartment 21, a first stirring screw 23 is arranged, and in the second storage compartment 22, a second stirring screw 24 is arranged. In a top part of the developing container 20, a toner iced port 20*a* is provided through which, according to the result of detection by a toner sensor (not shown) which detects the amount of toner inside the developing container 20, the toner stored in the toner container 5 (see FIG. 1) is fed via the intermediary hopper 6 (see FIG. 1). A guide section 26, to which the later-described toner transport passage 70 (see FIG. 4) is coupled, is provided so as to surround the toner feed port 20*a*.

The first and second stirring screws 23 and 24 each have a helical blade provided about a shaft at the center, and are rotatably pivoted on the developing container 20 so as to be parallel with each other. There is no partition wall at both ends in the longitudinal direction of the developing container 20 (the direction perpendicular to the plane of FIG. 2), that is, the axial direction of the first and second stirring screws 23 and 24, and this permits toner to be transported between the first and second stirring screws 23 and 24. Thus, the first stirring screw 23 transports, while stirring, the toner inside the first storage compartment 21 to the second storage compartment 22. On the other hand, the second stirring screw 24 transports, while stirring, the toner transported to the second storage compartment 22 to feed it to a developing roller 25.

The developing roller 25 is rotatably pivoted on the developing container 20 so as to be parallel to the first and second stirring screws 23 and 24. Inside the developing roller 25, a magnet member 27 is fixed which is composed of a permanent magnet having a plurality of magnetic poles. The magnetic force of the magnet member 27 permits toner to adhere to (be carried on) the surface of the developing roller 25 to form a thin layer of toner. Part of the outer circumferential surface of the developing roller 25 is exposed outside the developing container 20, and the exposed part is arranged so as to face the photosensitive drum 1 (see FIG. 1).

The developing roller 25 having the thin layer of toner formed on it rotates as the photosensitive drum 1 rotates, and thereby toner is fed to the photosensitive layer of the photosensitive drum 1. The first stirring screw 23, the second stirring screw 24, and the developing roller 25 are driven to rotate at predetermined speeds by a motor and a gear train (not shown). At opposite ends of the developing roller 25, a magnetic seal member 28 is arranged which prevents leakage of toner through the gap between the developing container 20 and the developing roller 25.

A restricting blade 29 is formed to have, in its longitudinal direction, a width greater than the maximum development width of the developing roller 25. The restricting blade 29 is arranged at a predetermined interval from the developing roller 25 so as to form a layer thickness restricting portion 30 which restricts the amount of toner fed to the photosensitive drum 1. The gap in the layer thickness restricting portion 30 is set to be about 0.2 mm to 0.4 mm. Used as the material of the restricting blade 29 is, for example, magnetic or non-magnetic SUS (stainless steel). Here, a restricting blade 29 formed of a magnetic material is fitted with a permanent magnet 31 to have magnetism.

The magnet member 27 has a plurality of magnetic poles (not shown) composed of N and S poles. Since the magnetic poles of the magnet member 27 are opposed to the restricting blade 29, magnetic forces concentrate at the tip end of the restricting blade 29, and produce in the layer thickness restricting portion 30 a magnetic field in an attracting direction.

The magnetic field forms, between the restricting blade 29 and the developing roller 25, a toner chain (a magnetic brush) in which toner particles are linked together. Passage through the layer thickness restricting portion 30 achieves layer restriction, and as a result a thin layer of toner is formed on the developing roller 25. Owing to the arrangement of the permanent magnet 31 on the restricting blade 29, not only the interval of the layer thickness restricting portion 30 but also the magnetic field that is produced in the layer thickness restricting portion 30 provide an increased restricting power, and a thin layer of toner with a thickness of several tens of micrometers is formed on the developing roller 25. On the other hand, the toner that is not used in the formation of the thin layer of toner remains along the upstream-side (bottom-side in FIG. 2) side surface of the restricting blade 29. Thereafter, when the developing roller 25 rotates in the clockwise direction in FIG. 2 and the toner chain moves to the position facing the photosensitive drum 1, the toner chain, while keeping a constant distance from the surface of the photosensitive drum 1, forms a toner image.

Figure 3:
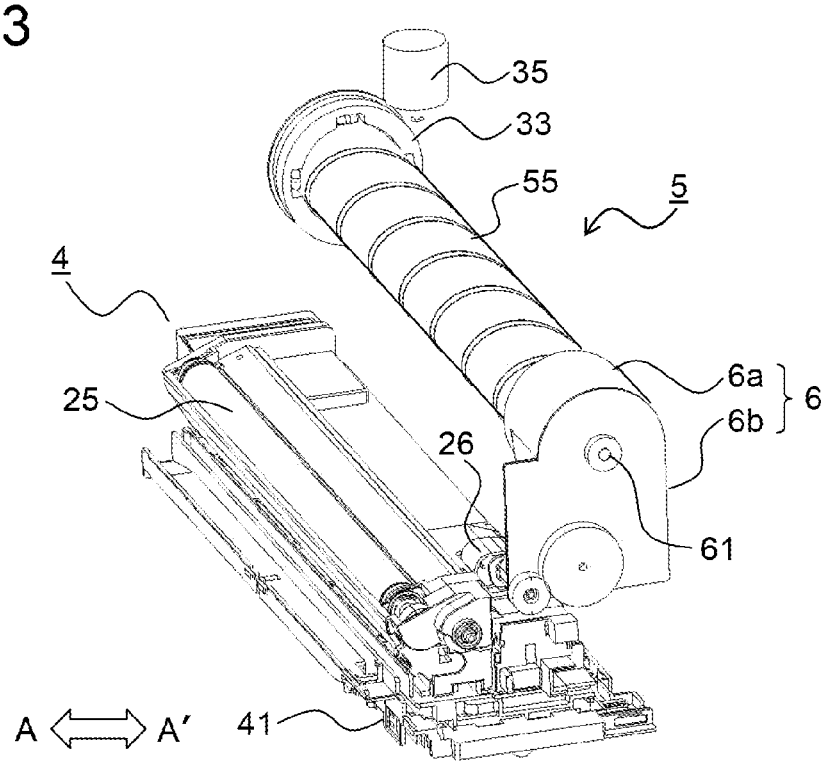
FIG. 3 is an exterior perspective view showing the positional relationship between the developing device 4, the toner container 5, and the intermediary hopper 6 in the image forming apparatus 100 shown in FIG. 1.
Figure 4:
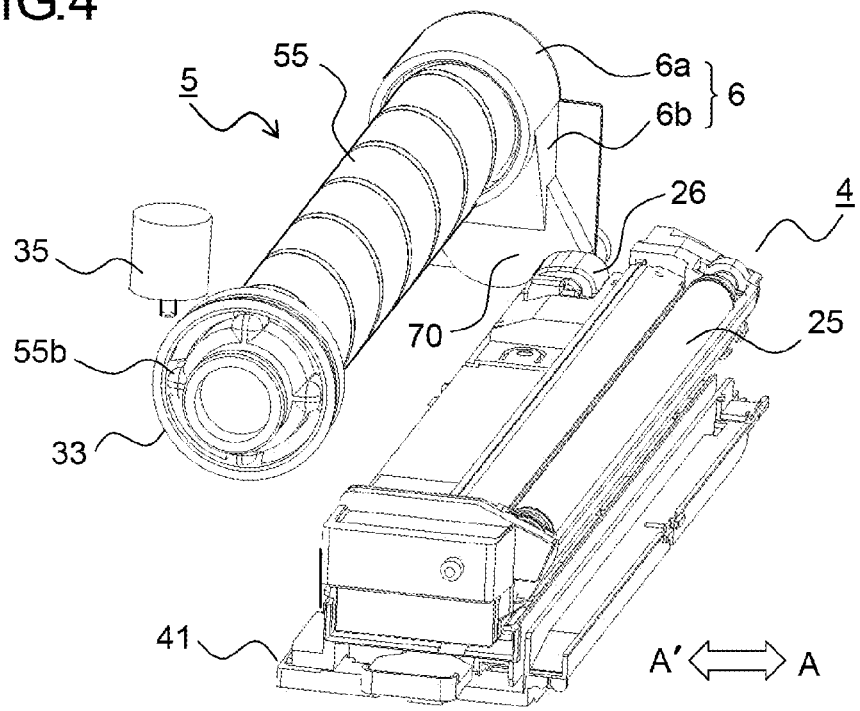
FIG. 4 is an exterior perspective view showing the positional relationship between the developing device 4, the toner container 5, and the intermediary hopper 6 in the image forming apparatus 100 as seen from behind FIG. 1.
Figure 5:
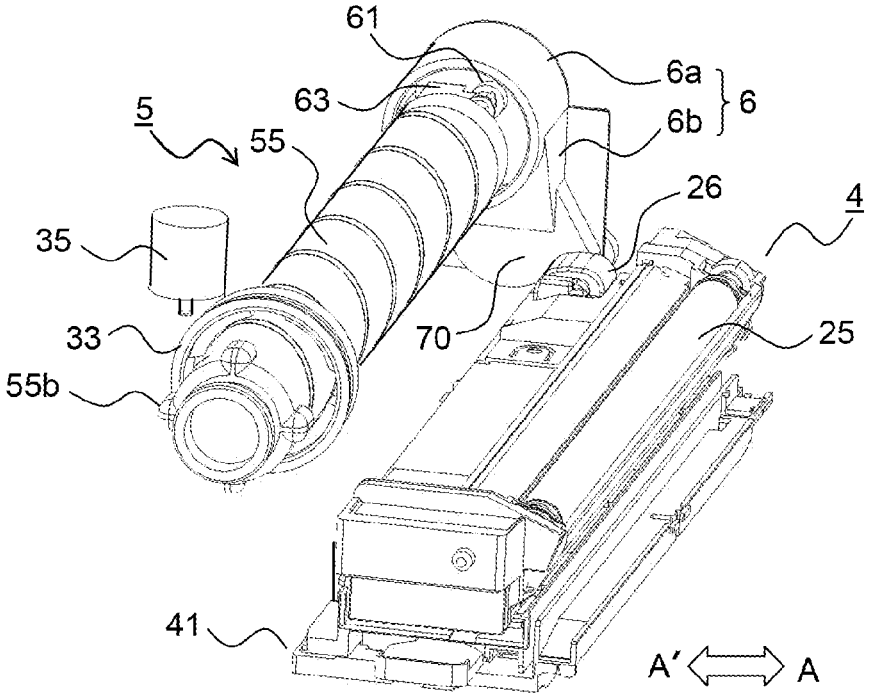
FIG. 5 is an exterior perspective view showing a state where the toner container 5 is removed from the state shown in FIG. 4.

FIGS. 3 and 4 are exterior perspective views showing the positional relationship between the developing device 4, the toner container 5, and the intermediary hopper 6. FIG. 5 is an exterior perspective view showing a state where the toner container 5 is removed from the state shown in FIG. 4. FIG. 3 shows the developing device 4, the toner container 5, and the intermediary hopper 6 as seen from the rear side of the image forming apparatus 100 (from behind FIG. 1).

The developing device 4 is placed on a support frame 41 which is movable in the horizontal direction (indicated by arrows A-A') relative to the main body of the image forming apparatus 100 (see FIG. 1). As the support frame 41 moves in the direction indicated by arrow A, the developing device 4 moves to a position (hereinafter referred to as the developing position) in which the developing roller 25 faces the photosensitive drum 1 with a predetermined gap in between and can feed toner to the photosensitive drum 1. On the other hand, as the support frame 41 moves in the direction indicated by arrow A', the developing device 4 moves to a position (hereinafter referred to as the fitting/removing position) in which the developing roller 25 is apart from the photosensitive drum 1 and can be fitted to and removed from the main body of the image forming apparatus 100.

When the developing device 4 is located in the fitting/removing position, it can be fitted to or removed from the support frame 41 by being inserted or extracted in the direction perpendicular to the plane of FIG. 4 along the bottom surface of the support frame 41. When the developing device 4 is located in the developing position, toner can be fed from it to the photosensitive drum 1. The movement mechanism of the support frame 41 will be described later.

The intermediary hopper 6 is composed of a hopper top portion 6*a* which is fixed to the image forming apparatus 100 and which is fitted with the toner container 5 and a hopper bottom portion 6*b* which is coupled to the hopper top portion 6*a*. Inside the hopper top portion 6*a*, them are arranged a rotary shaft 61 on which the toner container 5 is rotatably supported and a paddle 63 which rotates along with the toner container 5 about the rotary shaft 61. To the hopper bottom portion 6*b*, a toner transport passage 70 through which toner is transported to the toner feed port 20*a* of the developing device 4 is coupled so as to protrude down, and the inside of the hopper bottom portion 6*b* and the inside of the toner transport passage 70 communicate with each other. The toner transport passage 70 is formed of a rigid material, and inside the toner transport passage 70, there is arranged a spiral (not shown) for transporting the toner inside the intermediary hopper 6 to the developing device 4.

The toner container 5 has engagement protuberances 55*b* formed at four places in one end part of the outer circumferential surface of a cylindrical container body 55. In the main body of the image forming apparatus 100, there are arranged a ring-shaped coupling 33 which engages with the engagement protuberances 55*b* and a motor 35 which drives the coupling 33 to rotate.

A developing device 4-side end part of the toner transport passage 70 is slideably inserted into a guide portion 26 of the developing device 4. Thus, the guide portion 26 functions as a linking member which couples the developing device 4 to the toner transport passage 70 such that the former is movable relative to the latter in the horizontal direction, and with the intermediary hopper 6 and the toner transport passage 70 fixed, the support frame 41 can reciprocate (move translationally) in the direction indicated by arrows A-A'.

Figure 6:
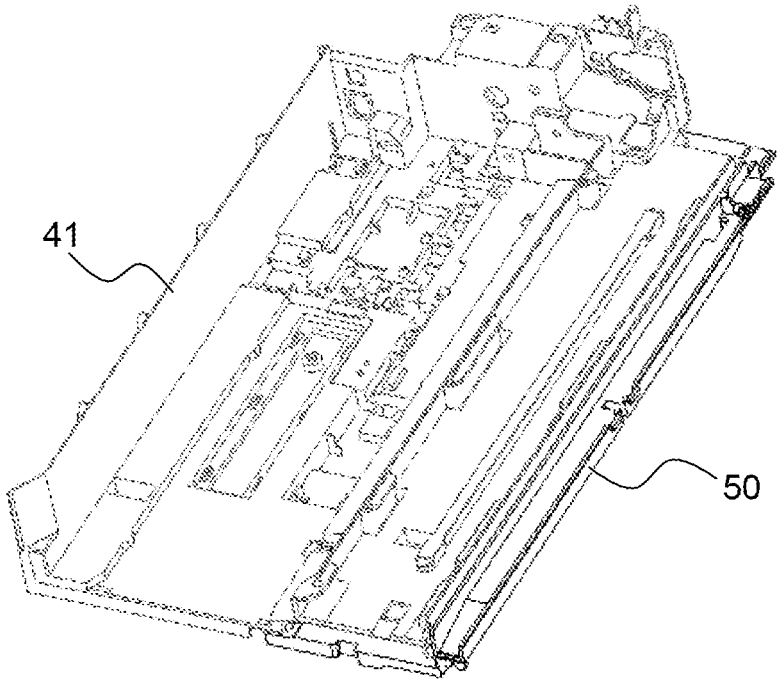
FIG. 6 is a perspective view showing a state where the support frame 41 is coupled to the frame fixing member 50 arranged in the main body of the image forming apparatus 100.
Figure 7:
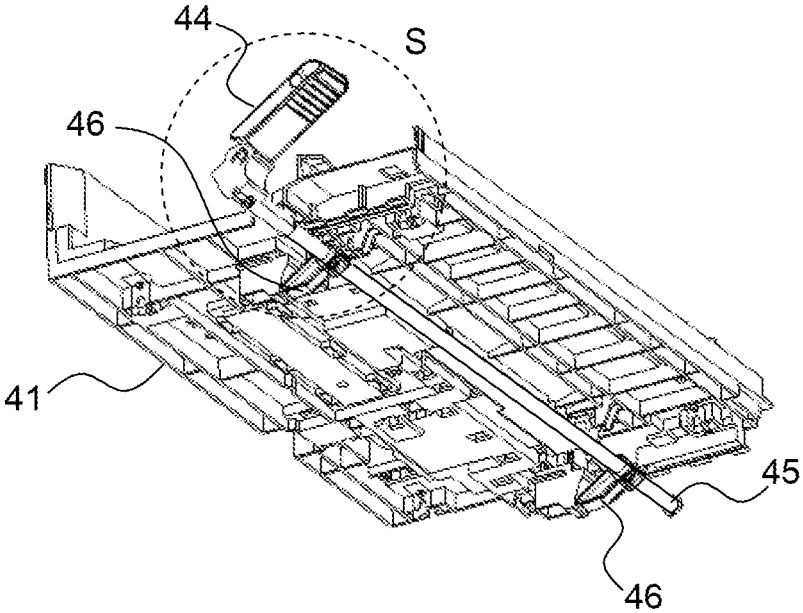
FIG. 7 is a perspective view of the support frame 41 and the developer release lever 44 as seen from below.
Figure 8:
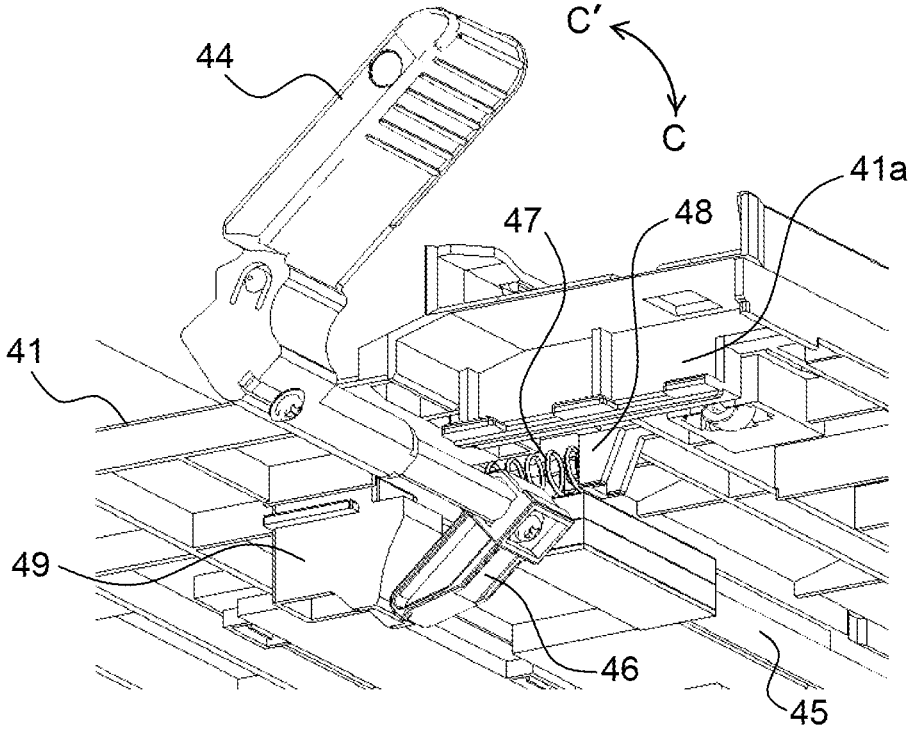
FIG. 8 is a partly magnified view of and around the claw 46 at one side.
Figure 9:
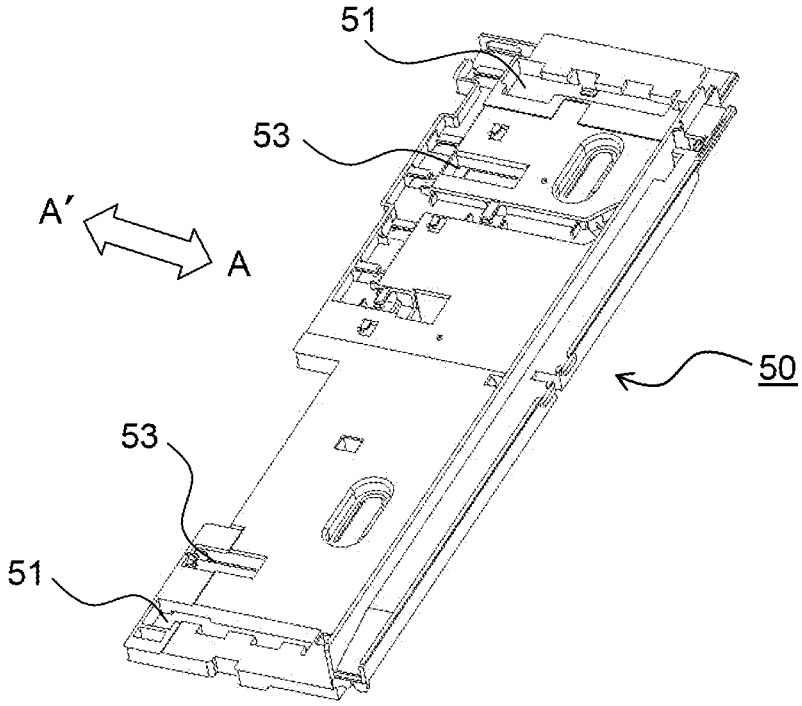
FIG. 9 is a perspective view of the frame fixing member 50 as seen from above.

Next, the movement mechanism of the support frame 41 will be described. FIG. 6 is a perspective view showing a state where the support frame 41 is coupled to a frame fixing member 50 arranged in the main body of the image forming apparatus 100. FIG. 7 is a perspective view of the support frame 41 and a developer release lever 44 as seen from below. FIG. 8 is a partly magnified view of and around a claw 46 at one end (inside the broken-line circle S in FIG. 7). FIG. 9 is a perspective view of the frame fixing member 50 as seen from above. In FIG. 6, the developer release lever 44 is omitted from illustration.

The developer release lever 44 is fixed to one end of a shaft 45 rotatably supported under the support frame 41. Near both ends of the shaft 45, two claws 46 are provided respectively, thus when the developer release lever 44 is operated, the shaft 45 and the claws 46 rotate. On the bottom side of the support frame 41, there are formed a pair of rails 41*a*, a pair of spring bases 48 which supports coil springs 47 at their one end and a pair of protrusions 49 arranged so as to face the claws 46 respectively.

The frame fixing member 50 is fixed to the main body of the image forming apparatus 100, and has formed in it rail engagement grooves 51 with which the rails 41*a* on the support frame 41 engage and spring spaces 53 in which the coil springs 47 are accommodated. That is, the coil springs 47 make contact, at opposite ends, with the spring bases 48 and the left-end inner wall surfaces of the spring spaces 53, and normally a biasing force toward the frame fixing member 50 (in the direction indicated by arrow A) is acting on the spring bases 48 of the support frame 41.

When the developer release lever 44 is rotated in the direction indicated by arrow C from the state shown in FIG. 8, the shaft 45 and the claws 46 rotate in the same direction, and the tip ends of the claws 46 press the side surfaces of the protrusions 49. This causes the support frame 41 to move in the direction indicated by arrow A', and the developing device 4 (see FIG. 4) moves to the fitting/removing position. Moreover, together with the support frame 41, the spring bases 48 move in the direction indicated by arrow A', and thus the coil springs 47 are pressed against the left-end inner wall surface of the spring spaces 53 and are compressed.

Next, when the developer release lever 44 is rotated in the direction indicated by arrow C' and is brought back into the state shown in FIG. 8, the shaft 45 and the claws 46 rotate in the same direction, and thus the tips of the claws 46 come apart from the side surfaces of the protrusions 49. This causes the thus far compressed coil springs 47 to expand and press the spring bases 48, and thus the support frame 41 moves in the direction indicated by arrow A, and the developing device 4 (see FIG. 4) moves to the developing position.

Figure 10:
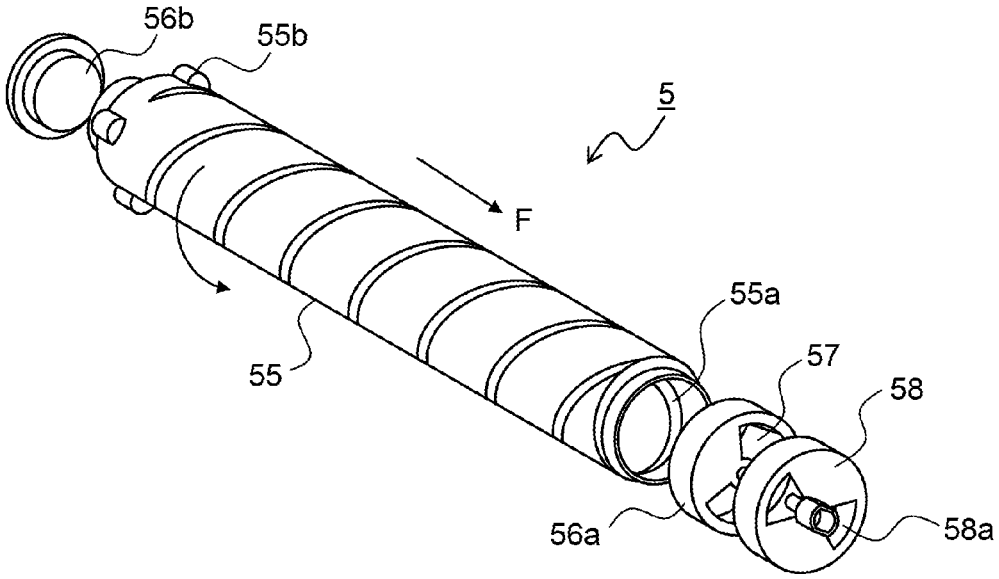
FIG. 10 is an exploded perspective view of the toner container 5 according to a first embodiment of the present disclosure.
Figure 11:
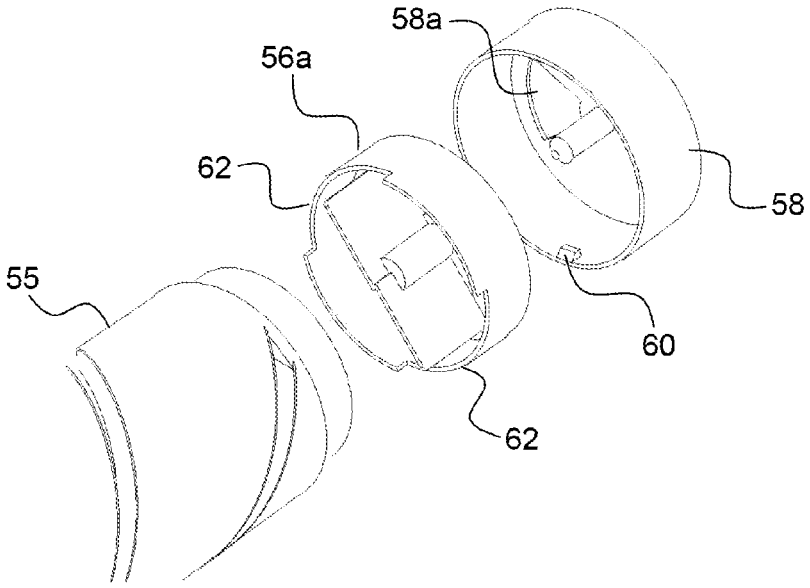
FIG. 11 is a magnified view of one (the cap 56*a*-side) end part of the toner container 5 shown in FIG. 10.

FIG. 10 is an exploded perspective view of the toner container 5 according to a first embodiment of the present disclosure. FIG. 11 is a magnified view of one (cap 56*a*-side) end part of the toner container 5 shown in FIG. 10. The toner container 5 has a cylindrical container body 55 and caps 56*a* and 56*b* fitted to opposite ends of the container body 55. On the inner wall surface of the container body 55, a helical transport rib 55*a* is formed, and at four places on the outer circumferential surface in the end (left-end in FIG. 10) part of the container body 55 located at the front side of the image forming apparatus 100, engagement protuberances 55*b* are provided.

In the intermediary hopper 6-side cap 56*a*, two fan-shaped toner discharge ports 57 are formed. Outward of the cap 56*a*, a shutter 58 is arranged in which openings 58*a* having approximately the same shape as the toner discharge ports 57 are formed. The coupling 33-side cap 56*b* is removably fitted to the container body 55 so that, with the cap 56*b* removed, the container body 55 can be replenished with toner.

When the toner container 5 supported on the rotary shaft 61 (see FIG. 5) of the intermediary hopper 6 is rotated forward (in the counter-clockwise direction in FIG. 10), as the phase of the transport rib 55*a* advances, the toner contained inside the container body 55 gradually moves along the axial direction (the direction indicated by arrow F) from the cap 56*b* side to the cap 56*a* side (the intermediary hopper 6 side).

The shutter 58 is a cylindrical member with an inner diameter slightly greater than the outer diameter of the cap 56*a*, and at two opposite places at an edge of the inner circumferential surface of the shutter 58, projections 60 that project inward are formed. At two opposite places at an edge of the outer circumferential surface of the cap 56*a*, cuts 62 are formed with which the projections 60 engage. In FIG. 11, only the projection 60 at one side is shown.

Figure 12:
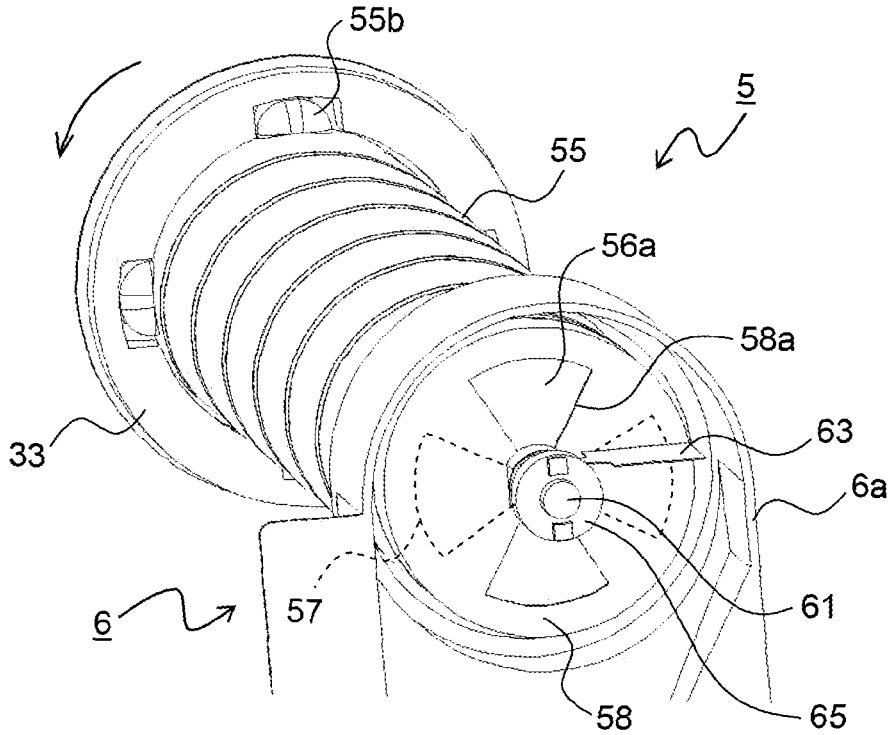
FIG. 12 is a perspective view of the toner container 5 connected to the hopper top portion 6*a* as seen from inside the hopper top portion 6*a*, showing a state where the toner discharge ports 57 are closed.
Figure 13:
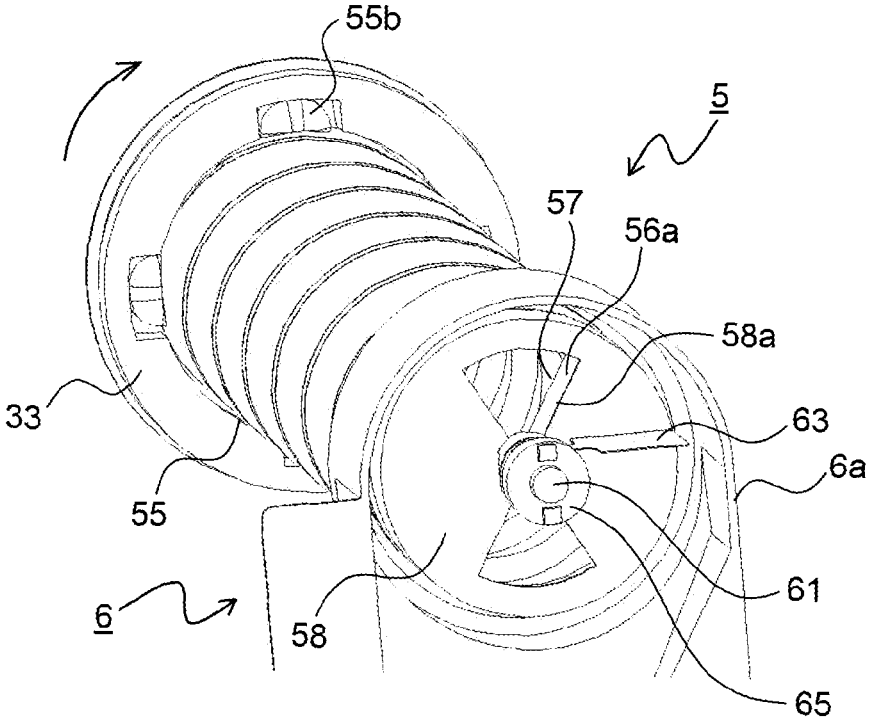
FIG. 13 is a perspective view or the toner container 5 connected to the hopper top portion 6*a* as seen from inside the hopper top portion 6*a*, showing a state where the toner discharge ports 57 are open.

FIGS. 12 and 13 are perspective views of the toner container 5 connected to the hopper top portion 6*a* of the intermediary hopper 6, as seen from inside the hopper top portion 6*a*. With the engagement protuberances 55*b* of the toner container 5 located at the front side of the image forming apparatus 100, a coupling 33 engages. An end part of the toner container 5 located in a rear part of the image forming apparatus 100 is rotatably supported on the rotary shaft 61. Where the shutter 58 and the rotary shaft 61 are coupled together, a torque limiter 65 is provided so that, only when a predetermined or higher torque is applied to the shutter 58, the shutter 58 rotates about the rotary shaft 61.

When, the toner container 5 is connected to the hopper top portion 6*a*, as shown in FIG. 12, the openings 58*a* in the shutter 58 are located in a position approximately 90 degrees rotated relative to the toner discharge ports 57 in the cap 56*a*, and thus the toner discharge ports 57 are closed by the shutter 58. The projections 60 (see FIG. 11) on the shutter 58 are engaged with the downstream-side ends of the cuts 62 (see FIG. 11) in the cap 56*a* with respect to the forward rotation direction of the container body 55 (the counter-clockwise direction in FIG. 12).

When the coupling 33 is rotated forward by the motor 35 (see FIG. 11) from the state shown in FIG. 12, the container body 55 and the cap 56*a* start to rotate forward about the rotary shaft 61. At this time, the rotation torque applied to the torque limiter 65 is lower than the torque required for the torque limiter 65 to rotate, and thus the shutter 58 does not rotate together with the container body 55 and the cap 56*a* but remains stationary.

When the container body 55 and the cap 56*a* rotates through approximately 90 degrees as shown in FIG. 13, the toner discharge ports 57 in the cap 56*a* become coincident with the openings 58*a* is the shutter 58, and thus the toner discharge ports 57 are opened. The upstream-side ends of the cuts 62 with respect to the forward rotation direction then move to the position of the projections 60 on the shutter 58, and thus a rotation torque is transmitted from the container body 55 and the cap 56*a* to the torque limiter 65.

Here, the rotation torque transmitted to the torque limiter 65 is higher than the torque required for the torque limiter 65 to rotate, and thus the shutter 58, while keeping the toner discharge ports 57 open, rotates forward together with the container body 55 and the cap 56*a*. Thus, by rotating the container body 55 forward, the toner inside the container body 55 is fed through the toner discharge ports 57 and the openings 58*a* to the intermediary hopper 6.

On the other hand, to stop the feeding of toner from the toner container 5, when the coupling 33 is rotated reversely (in the clockwise direction in FIG. 13) by the motor 35 (see FIG. 11) from the state shows in FIG. 13, the container body 55 and the cap 56*a* start to rotate reversely together about the rotary shaft 61. As a result, the upstream-side ends of the cuts 62 with respect to the forward rotation direction (its downstream-side ends with respect to the reverse rotation direction) come apart from the projections 60.

Thereafter, until the upstream-side ends of the cuts 62 with respect to the reverse rotation direction make contact with the projections 60, the rotation torque of the container body 55 and the cap 56*a* is not transmitted to the torque limiter 65, and thus the shutter 58 remains stationary in the position shown in FIG. 13, while the container body 55 and the cap 56*a* alone rotate reversely. As a result, the openings 58*a* in the shutter 58 move to the position shown in FIG. 12 where they no longer coincide with the toner discharge ports 57 in the cap 56*a*, and thus the toner discharge ports 57 are closed.

With this construction, when the toner container 5 is connected to the intermediary hopper 6, and also when the toner container 5 is removed from the intermediary hopper 6, the shutter 58 reliably keeps the toner discharge ports 57 closed. Thus, it is possible to effectively prevent leakage of toner through the toner discharge ports 57 and the resulting contamination of the inside and outside of the image forming apparatus 100 with toner.

Moreover, since the operation that makes the toner container 5 rotate causes the shutter 58 to open and close the toner discharge ports 57 automatically, no extra operation is required to open and close the toner discharge ports 57. This facilitates the replacement of the toner container 5, and eliminates the risk of toner not being fed as a result of the user forgetting to open the toner discharge ports 57 when connecting the toner container 5 and the risk of toner leaking as a result of the user forgetting to close the toner discharge ports when replacing the toner container 5. Nor does the toner container 5 need to be provided with a mechanism for opening and closing the shutter 58. This gives the toner container 5 an inexpensive, simple construction, and helps reduce maintenance cost.

Figure 14:
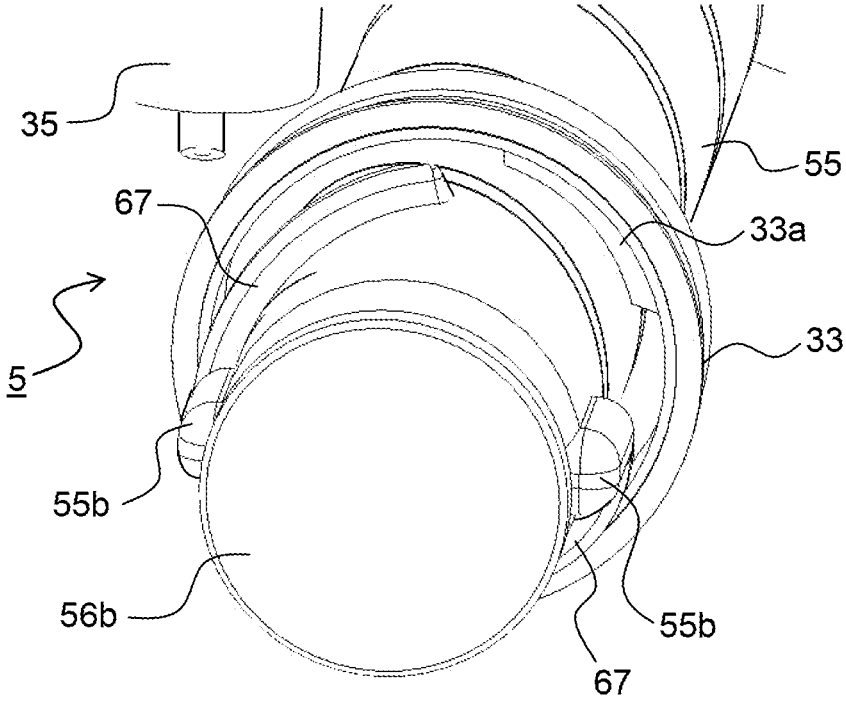
FIG. 14 is a partly magnified view of the toner container 5 according to a second embodiment of the present disclosure in a state being inserted into the image forming apparatus 100, as seen from in front of the image forming apparatus 100.
Figure 15:
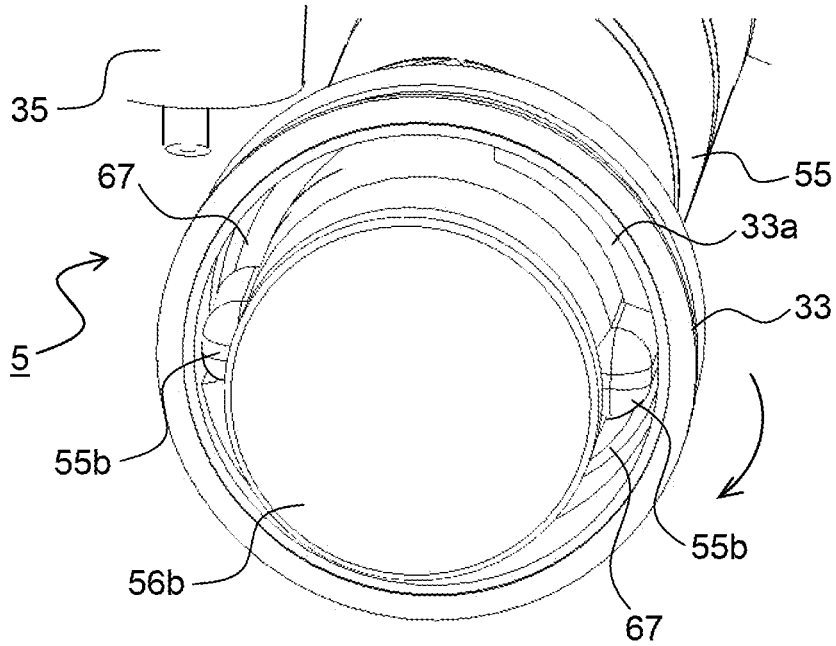
FIG. 15 is a partly magnified view of the toner container 5 according to the second embodiment of the present disclosure in a state inserted in the image forming apparatus 100, as seen from in front of the image forming apparatus 100.
Figure 16:
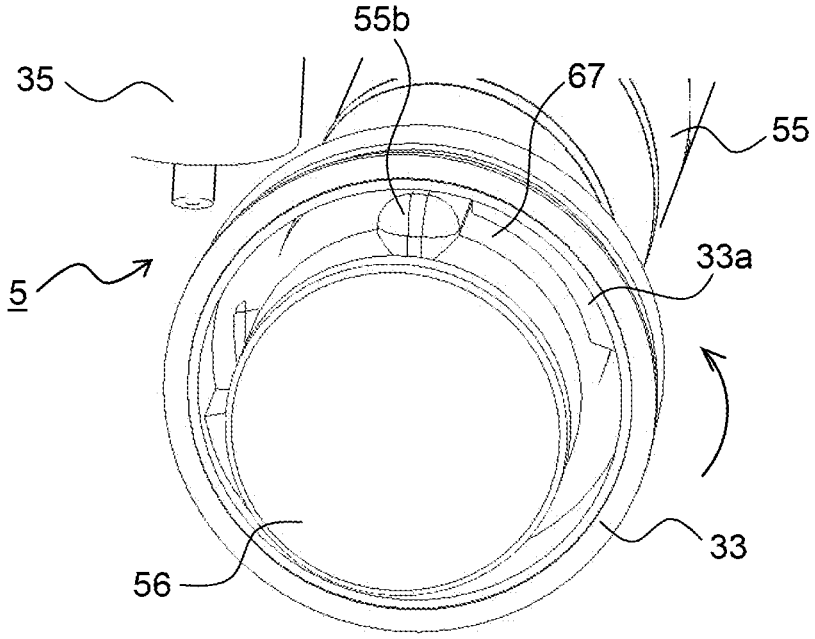
FIG. 16 is a partly magnified view of the toner container 5 according to the second embodiment in a state rotated so that the toner container 5 and the coupling 33 are locked together, as seen from in front or the image forming apparatus 100.

Next, a description will be given of a construction that permits the toner discharge ports 57 to be opened and closed by manual rotation of the shutter 58 when the toner container 5 is connected or removed. FIG. 14 is a partly magnified view showing a toner container 5 according to a second embodiment of the present disclosure in a state of being inserted into the image forming apparatus 100. FIG. 15 is a partly magnified view of the toner container 5 according to the second embodiment in a state inserted in the image forming apparatus 100. FIG. 16 is a partly magnified view of the toner container 5 and the coupling 33 in a state locked together from the state shown in FIG. 15.

In the toner container 5 according to this embodiment, engagement protuberances 55*b* are provided at two opposite places on the outer circumferential surface of the container body 55. Also provided are helical projections 67 that helically extend from the engagement protuberances 55*b*, respectively, along the outer circumferential surface of the container body 55. On the other hand, on the coupling 33, engagement ribs 33*a* are formed which engage with the helical projections 67 as the container body 55 is rotated. Otherwise, the toner container 5 has the same construction as in the first embodiment shown in FIG. 10.

To connected the toner container 5 to the image forming apparatus 100, as shown in FIG. 14, the toner container 5 is inserted, from its shutter 58-side end, into the coupling 33. As shown in FIG. 15, when the toner container 5 is completely inserted, the end of the shutter 58 is supported on the rotary shaft 61 (see FIG. 12), and in addition the engagement protuberances 55*b* on the container body 55 are located in a position overlapping the coupling 33.

When the cap 56*b* of the toner container 5 is held and rotated manually forward through a predetermined angle (in the clockwise direction in FIG. 15), as shown in FIG. 16, the helical projections 67 on the container body 55 mesh with the engagement ribs 33*a* on the coupling 33, and thus the toner container 5 and the coupling 33 are engaged and fixed (locked) together. At this time, while the container body 55 and the cap 56*a* rotate forward through a predetermined angle (about 90 degrees) about the rotary shaft 61, the shutter 58, to which the torque limiter 65 is coupled, does not rotate together with the container body 55 and the cap 56*a* but remains stationary. As a result, the toner discharge ports 57 become coincident with the openings 58*a* (see FIG. 13), and thus the toner discharge ports 57 are opened.

On the other hand, to remove the toner container 5 from the hopper top portion 6*a*, when the cap 56*b* of the toner container 5 is held and rotated manually reversely (in the counterclockwise direction in FIG. 15) through a predetermined angle, the helical projections 67 disengage from the engagement ribs 33*a*, and thus the toner container 5 and the coupling 33 are unlocked from each other. At this time, while the container body 55 and the cap 56*a* rotate reversely through a predetermined angle (about 90 degrees) about the rotary shall 61, the shutter 58, to which the torque limiter 65 is coupled, does not rotate together with the container body 55 and the cap 56*a* but remains stationary. As a result, a position is reached where the toner discharge ports 57 and the openings 58*a* no longer coincide with each other (see FIG. 12), and thus the toner discharge ports 57 are closed.

Thus, with the construction that permits manual rotation of the shutter 58, as with the construction that permits rotation of the shutter 58 by use of the coupling 33 and the motor 35, when the toner container 5 is connected to the intermediary hopper 6, and also when the toner container 5 is removed from the intermediary hopper 6, the shutter 58 reliably keeps the toner discharge ports closed. It is thus possible to reliably prevent leakage of toner through the toner discharge ports 57.

Moreover, since the operation that locks or unlocks the toner container 5 causes the shutter 58 to open or close the toner discharge ports 57 automatically, there is no risk of the user forgetting to perform the operation of opening or closing the toner discharge ports 57. Moreover, since the toner container 5 does not need to be provided with a mechanism for opening and closing the shutter 58, it is possible to give the toner container 5 an inexpensive, simple construction. Furthermore, since there is no need to rotate the coupling 33 reversely to make the shutter 58 close the toner discharge ports 57, it is possible to simplify the driving and control of the motor 35.

The present disclosure is in no way limited by the embodiments presented above, and encompasses any variations and modifications made within the spirit of the present disclosure. For example, although the embodiments presented above deal with constructions that employ a developing device 4 that uses a single-component developer as shown in FIG. 2, this is not meant to be any limitation. It is also possible to use a developing device 4 that uses a two-component developer composed of non-magnetic toner and magnetic carrier. In that case, the non-magnetic toner is contained in the toner container 5, and according to the amount of toner consumed in the developing device 4, the toner is fed from the toner container 5 via the intermediary hopper 6 to the developing device 4. In a developing device 4 of the type that feeds both toner and magnetic carrier and discharges surplus developer, a two-component developer is contained in the toner container 5.

That is, contained as "developer" in the toner container 5 (developer container) is a single-component developer containing toner alone, a two-component developer containing toner and magnetic carrier, or the toner of a two-component developer.

Although, in the embodiments presented above, the toner discharge ports 57 are formed in the cap 56*a* which is fixed to the intermediary hopper 6-side end of the container body 55, instead, an opening may be formed only at the end of the container body 55 at the front side of the main body of the image forming apparatus where the cap 56*b* is fitted, while the intermediary hopper 6-side end of the container body 55 is given a closed shape, so that a toner discharge port 57 is formed directly in the container body 55.

The present disclosure is applicable to image forming apparatuses provided with a removable developer container that feeds developer by rotating the container body. According to the present disclosure, the developer discharge port can be opened and closed in a fashion coordinated with the connecting and removal of the developer container, or with the feeding of developer. Thus, it is possible to provide a developer container with a simple construction free from leakage of developer at the time of its connecting or removing, and to provide an image forming apparatus provided with such a developer container.

What is claimed is:

1. An image forming apparatus comprising:

a developer container which is removably connected to an image forming apparatus main body and which includes:

a cylindrical container body in which developer is contained;

a developer discharge port which is formed at one end of the container body and through which the developer inside the container body is discharged; and a shutter which is rotatable through a predetermined angle relative to the container body and which is so fitted as to restrict rotation relative to the container body at both ends of the predetermined angle, the shutter having an opening formed in part of a surface thereof facing the developer discharge port, the container body being rotated in a circumferential direction to cause the developer to be discharged through the developer discharge port;

a developer feeding mechanism which rotatable supports the developer container and which feeds the developer discharged through the developer discharge port to a developing device;

a drive mechanism which drives the developer container to rotate in a developer feeding direction; and a torque limiter which is provided on the developer feeding mechanism and which engages with the shutter when the developer container is connected to the image forming apparatus main body, the image forming apparatus being configured such that when the developer container is rotated in the developer feeding direction, while the torque limiter keeps the shutter stationary, the container body rotates through a predetermined angle to open the developer discharge port, and as the developer container continues to be rotated, the shutter, while keeping the developer discharge port open, rotates together with the container body to allow the developer to be fed through the developer discharge port, and when the developer container is rotated in a direction reverse to the developer feeding direction, while the torque limiter keeps the shutter stationary, the container body rotates through a predetermined angle in a reverse direction to close the developer discharge port.

2. The image forming apparatus according to claim 1, wherein the drive mechanism can drive the developer container also in a direction reverse to the developer feeding direction, the drive mechanism opening the developer discharge port when performing a developer feeding operation in which the drive mechanism rotates the developer container in the developer feeding direction, the drive mechanism closing the developer discharge port by rotating the developer container in the direction reverse to the developer feeding direction when stopping the developer feeding operation.

3. The image forming apparatus according to claim 1, wherein by manually rotating the developer container through a predetermined angle in the developer feeding direction, the developer container and the drive mechanism are engaged and fixed together and the developer discharge port is opened, and by manually rotating the developer container through a predetermined angle in a direction reverse to the developer feeding direction, the developer container and the drive mechanism are disengaged from each other and the developer discharge port is closed.

4. A developer container removably connected to an image forming apparatus comprising:

a developer feeding mechanism which rotatably supports a developer container and which feeds developer discharged through a developer discharge port formed in the developer container to a developing device;

a drive mechanism which drives the developer container to rotate in a developer feeding direction; and a torque limiter which is provided on the developer feeding mechanism and which, when the developer container is connected to an image forming apparatus main body, engages with a shutter which is rotatably fitted to a container body of the developer container and which has an opening formed in part of a surface thereof facing the developer discharge port, the image forming apparatus being configured such that when the developer container is rotated in the developer feeding direction, while the torque limiter keeps the shutter stationary, the container body rotates through a predetermined angle to open the developer discharge port, and as the developer container continues to be rotated, the shutter, while keeping the developer discharge port open, rotates together with the container body to allow the developer to be fed through the developer discharge port, and when the developer container is rotated in a direction reverse to the developer feeding direction, while the torque limiter keeps the shutter stationary, the container body rotates through a predetermined angle in a reverse direction to close the developer discharge port, the developer container comprising a container body, a developer discharge port, and a shutter, the container body being cylindrical and containing the developer therein, the developer discharge port being formed at one end of the container body and allowing the developer inside the container body to be discharged therethrough, the shutter being fitted so as to be rotatable through a predetermined angle relative to the container body and having an opening formed in part of a surface thereof facing the developer discharge port, and the container body being rotated in a circumferential direction to cause the developer to be discharged through the developer discharge port.

5. The developer container according to claim 4, wherein the shutter is a cylindrical member that is open at one end, the shutter having an inner diameter slightly greater than an outer diameter of the cylindrical container body, and a projection formed on an inner circumferential surface of the shutter engages with a cut formed in a predetermined area in an outer circumferential surface of the container body such that the shutter is rotatable relative to the container body within the area of the cut.

6. The developer container according to claim 4, wherein a helical transport rib is formed on an inner wall surface of the container body.

7. The developer container according to claim 4, wherein a cap is removably fitted to the container body at an end thereof opposite from the developer discharge port.

* * * * *